US010305214B2

(12) United States Patent
Kimura et al.

(10) Patent No.: US 10,305,214 B2
(45) Date of Patent: May 28, 2019

(54) TERMINAL FITTING AND CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akio Kimura, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/770,788

(22) PCT Filed: Oct. 7, 2016

(86) PCT No.: PCT/JP2016/079890
§ 371 (c)(1),
(2) Date: Apr. 25, 2018

(87) PCT Pub. No.: WO2017/073289
PCT Pub. Date: May 4, 2017

(65) Prior Publication Data

US 2018/0323528 A1 Nov. 8, 2018

(30) Foreign Application Priority Data

Oct. 28, 2015 (JP) ..... 2015-212077
Dec. 17, 2015 (JP) ..... 2015-245962

(51) Int. Cl.
*H01R 13/24* (2006.01)

(52) U.S. Cl.
CPC ..... *H01R 13/2421* (2013.01); *H01R 2201/26* (2013.01)

(58) Field of Classification Search
CPC ..... H01R 13/2421
See application file for complete search history.

(56) References Cited

U.S. PATENT DOCUMENTS 4,553,192 A * 11/1985 Babuka ..... H05K 3/325 361/743
6,494,748 B1 * 12/2002 Mori ..... H01R 13/2421 439/700

(Continued)

FOREIGN PATENT DOCUMENTS

JP 9-27369 1/1997
JP 11-260449 9/1999

(Continued)

OTHER PUBLICATIONS

International Search Report and Written Opinion dated Dec. 20, 2016.

*Primary Examiner* — Ross N Gushi
(74) *Attorney, Agent, or Firm* — Gerald E. Hespos; Michael J. Porco; Matthew T. Hespos

(57) ABSTRACT

A terminal fitting includes a case (20) provided with an opening (31) into which a mating contact (91) is inserted, and an electrical contact member (60) disposed in the case (20) to face the opening (31) and configured to retreat while rotating to compress a resilient member (40) by being biased toward the opening (31) and pressed against the mating contact (91) by the resilient member (40).

5 Claims, 10 Drawing Sheets

(56) References Cited

U.S. PATENT DOCUMENTS

| | | | | |
|---|---|---|---|---|
| 6,932,620 | B2 * | 8/2005 | Ishiguro | H01Q 1/1271 439/66 |
| 7,077,709 | B1 * | 7/2006 | Shin-Ting | H01R 13/2421 439/289 |
| 7,736,202 | B1 * | 6/2010 | Kaiser | H01R 13/2421 439/824 |
| 2018/0316113 | A1 * | 11/2018 | Nishida | H01R 13/2421 |
| 2018/0316115 | A1 * | 11/2018 | Kimura | H01R 13/2442 |
| 2018/0323528 | A1 * | 11/2018 | Kimura | H01R 13/2421 |

FOREIGN PATENT DOCUMENTS

| | | |
|---|---|---|
| JP | 11-307161 | 11/1999 |
| JP | 2002-274290 | 9/2002 |

* cited by examiner

TERMINAL FITTING AND CONNECTOR

BACKGROUND

Field of the Invention

This specification relates to a terminal fitting and a connector for accommodating this terminal fitting.

Description of the Related Art

A method for butting and bringing facing contacts into contact for electrical connection, for example, in establishing electrical connection in an automotive vehicle or the like is known. In such a method, if external matter adheres between the contacts, a conduction failure is caused. Thus, in Japanese Unexamined Patent Publication No. 2002-274290, external matter between contacts is removed by causing the contacts to slide on each other when the contacts butt against each other.

Specifically, in a power supply device of Japanese Unexamined Patent Publication No. 2002-274290, end plates facing the inside of a case and a coil spring sandwiched and compressed between these end plates are provided in a female junction. A leaf spring member having a resilient force is provided on the end plate on a side exposed to outside. This leaf spring member is bent after extending out from the end plate to provide an inclined free end part that easily is deformed resiliently. A male contact and a female contact (free end part) slide on each other when contacting each other to remove an external matter between the contacts.

However, the configuration of Japanese Unexamined Patent Publication No. 2002-274290 cannot be utilized in the case of large current applications. This is because, in the case of large current applications, a bent part is difficult to resiliently deform since a plate thickness of the leaf spring member increases to increase rigidity. Thus, when the free end part of the leaf spring member contacts the male contact, shifting movements due to resilient deformation are less likely to occur and, as a result, the external matter adhering to a contact part cannot be removed sufficiently.

SUMMARY

A terminal fitting disclosed in this specification includes a case provided with an opening, and a mating contact is inserted into the opening. An electrical contact member is disposed in the case to face the opening. The electrical contact member is configured to retreat while rotating to compress a resilient member by being biased toward the opening and pressed against the mating contact by the resilient member.

In this configuration, the electrical contact member is received by the case and assumes a predetermined initial posture by being pressed toward the opening of the case by the resilient member in the case. If the mating contact is inserted through the opening of the case in such a state, the mating contact butts against the electrical contact member and the electrical contact member retreats to escape from the mating contact while compressing the resilient member. At this time, the electrical contact member retreats from the initial position while rotating to change an angle of inclination. Accordingly, the electrical contact member shifts to be rubbed at a contact part with the mating contact. Thus, even if an external matter is present between the contact and the mating contact, that external matter is scraped off. As just described, since the electrical contact member shifts relative to the mating contact even if the electrical contact member itself is not resiliently deformed, a plate thickness of the electrical contact member can be increased according to a current value.

An action axis of a biasing force of the resilient member is disposed on the same straight line as an action axis of a pressing force of the mating contact, and the electrical contact member may be held in an inclined state non-perpendicular to an action axis of the resilient member in the case. In this configuration, the electrical contact member can be rotated by a simple structure for only holding the electrical contact member in the inclined state.

The resilient member may be a coil spring. The electrical contact member may be held in an inclined state non-perpendicular to a center axis of the coil spring in the case. Additionally, an action axis of a pressing force of the mating contact may be disposed within an area of an annular winding end part in contact with the electrical contact member. In this configuration, the electrical contact member is held in the inclined state non-perpendicular to the center axis of the coil spring. Thus, a length on one side is shorter than a length on the other side across the center axis of the coil spring. Thus, a biasing force (spring force) applied to the electrical contact member differs on the one side and the other side across the center axis of the coil spring. The electrical contact member retreats by being pressed by the mating contact in this state. Thus, the mating contact acts as a supporting point and the electrical contact member rotates to change the inclined state so that spring forces at both sides of the center axis of the coil spring become equal since the action axis of the pressing force of the mating contact is disposed within the area of the annular winding end part of the coil spring. As a result, the electrical contact member and the mating contact shift relative to each other at a contact part thereof, thereby removing an external matter.

An intermediate terminal may be accommodated in the case and may be located to sandwich the resilient member between the terminal portion and the electrical contact member and may include a terminal portion for connection to outside. The intermediate terminal may be connected to the electrical contact member by a flexible braided wire.

In this configuration, connection to outside is made by the intermediate terminal. Thus, a rotating operation of the electrical contact member is not impeded by a connecting structure to outside. Further, since the electrical contact member is connected to the intermediate terminal by the braided wire and the braided wire is flexible, the rotating operation of the electrical contact member is less likely to be impeded.

The connector may include a connector housing capable of accommodating the terminal fitting. One end of the electrical contact member may be formed into a bent piece bent in a direction toward the mating contact, and the connector housing may be provided with a movement restricting portion for restricting a movement of the bent piece in a longitudinal direction of the electrical contact member.

In this configuration, the movement of the electrical contact piece in the longitudinal direction is restricted by the movement restricting portion of the connector housing. Thus, a movement of the electrical contact piece in the longitudinal direction during the rotating operation is restricted and the electrical contact piece is rotated easily.

According to the terminal fitting disclosed in this specification, an external matter between the contact and the mating contact can be removed even if a current value increases to increase the plate thickness.

DETAILED DESCRIPTION

An embodiment is described with reference to FIGS. 1 to 10. A terminal fitting 10 of this embodiment is connected electrically to a mating terminal 90 by being butted against the mating terminal 90. In the following description, an upper side in FIG. 2 and a lower side (side of the mating terminal 90) in FIG. 2 are referred to as an upper side and a lower side. Further, a left side in FIG. 2 and a right side (side of a braided wire 45) in FIG. 2 are referred to as a front and a rear.

Figure 1:
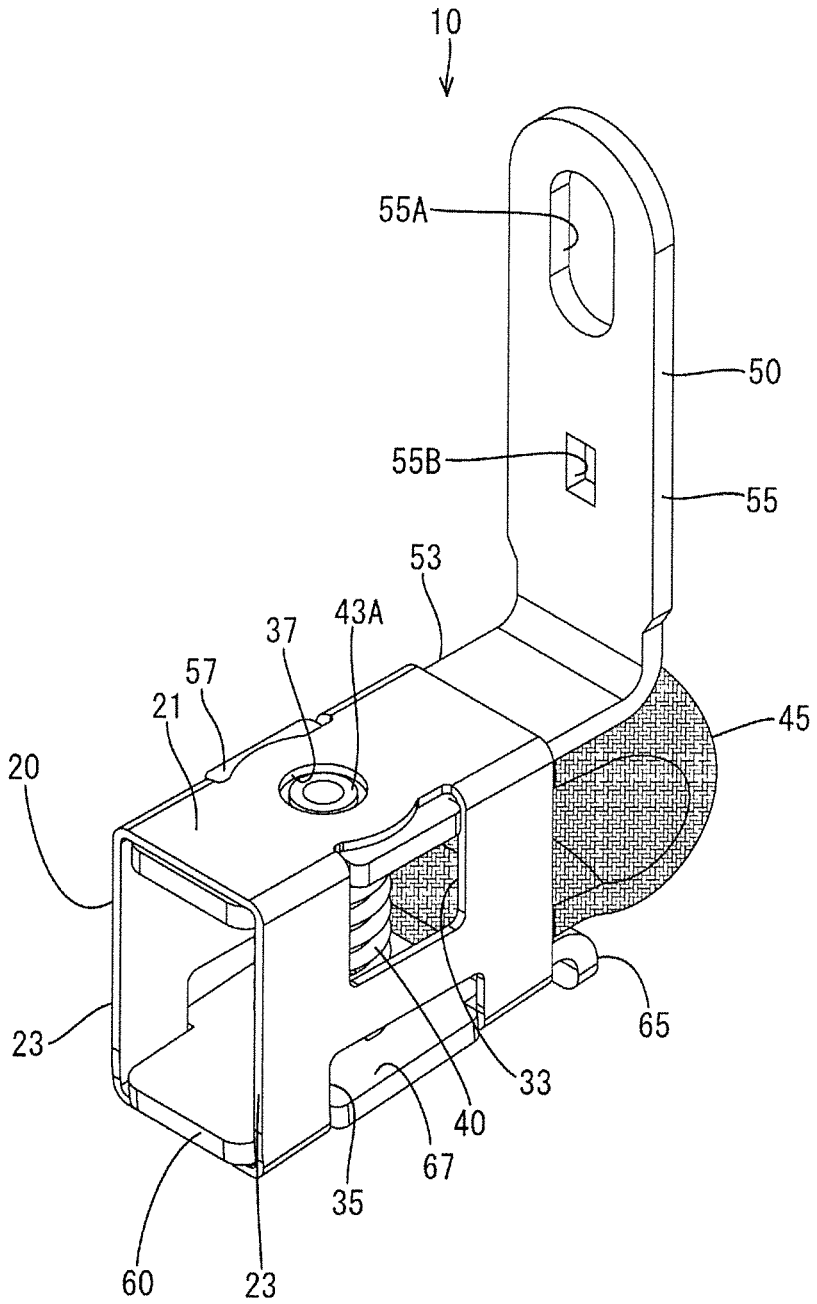
FIG. 1 is a perspective view of a terminal fitting in an embodiment.
Figure 2:
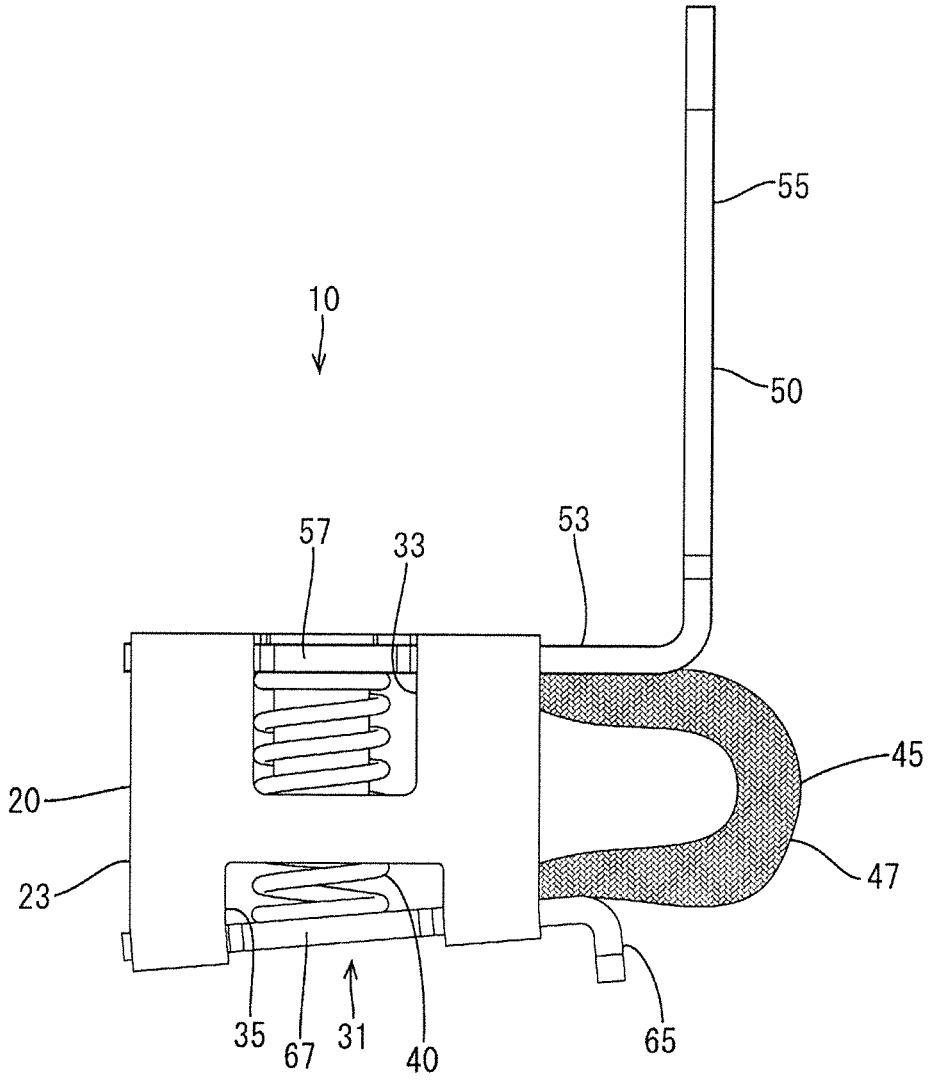
FIG. 2 is a front view of the terminal fitting.

The terminal fitting 10 includes, as shown in FIG. 1, a case 20, a coil spring 40 (example of a "resilient member") accommodated in a compressed state inside the case 20, an intermediate terminal 50 disposed above the coil spring 40, an electrical contact 60 disposed below the coil spring 40 and the braided wire 45 conductively connecting the intermediate terminal 50 and the electrical contact 60.

Figure 3:
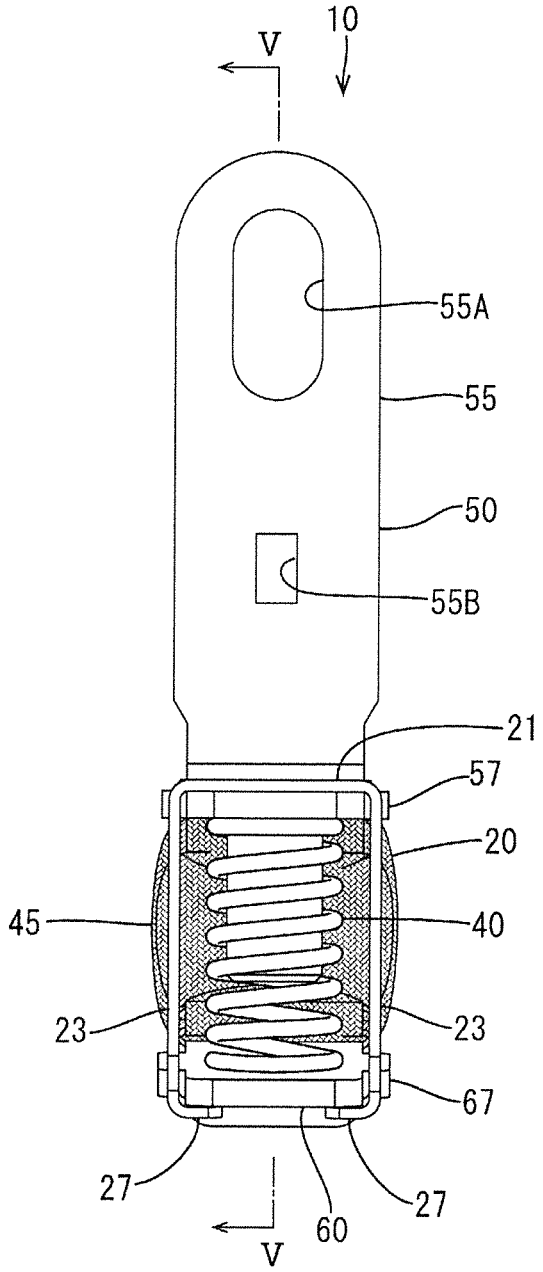
FIG. 3 is a side view of the terminal fitting.
Figure 4:
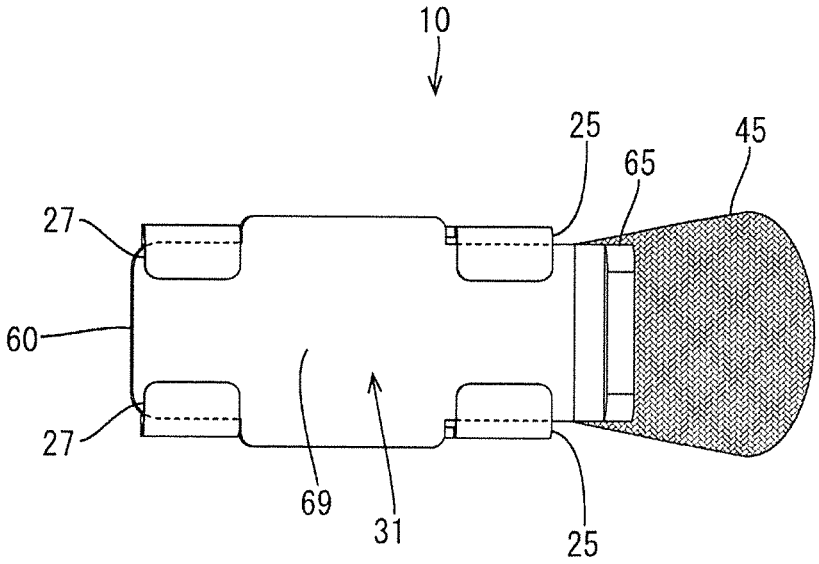
FIG. 4 is a bottom view of the terminal fitting.

The case 20 is formed by press-working a metal plate material such as a SUS material and includes, as shown in FIGS. 3 and 4, a ceiling wall 21, left and right side walls 23 extending down from both sides of the ceiling wall 21 and supports 25, 27 extending in from the lower ends of the side walls 23 while facing the ceiling wall 21. A part between the supports 25, 27 and facing the ceiling wall 21 serves as an opening 31 into which the mating terminal 90 is insertable.

As shown in FIGS. 1 and 2, a first opening 33 is provided at a substantially central position of the side wall 23 in a front-rear direction and is open down from a bent upper end of the side wall 23. Further, the side walls 23 are provided with two second openings 35 communicating with the opening 31 and open up. The second opening 35 is provided substantially at a central position of the side wall 23 in the front-rear direction and located between the supports 25, 27. The second opening 35 is wider and has a smaller vertical dimension than the first opening 33. The upper end of the second opening 35 is substantially parallel to the ceiling wall 21 and the intermediate terminal 50 and substantially perpendicular to a center axis L of the coil spring 40. Further, an escaping hole 37 penetrates through the ceiling wall 21 at a position between the left and right second openings 35.

Figure 5:
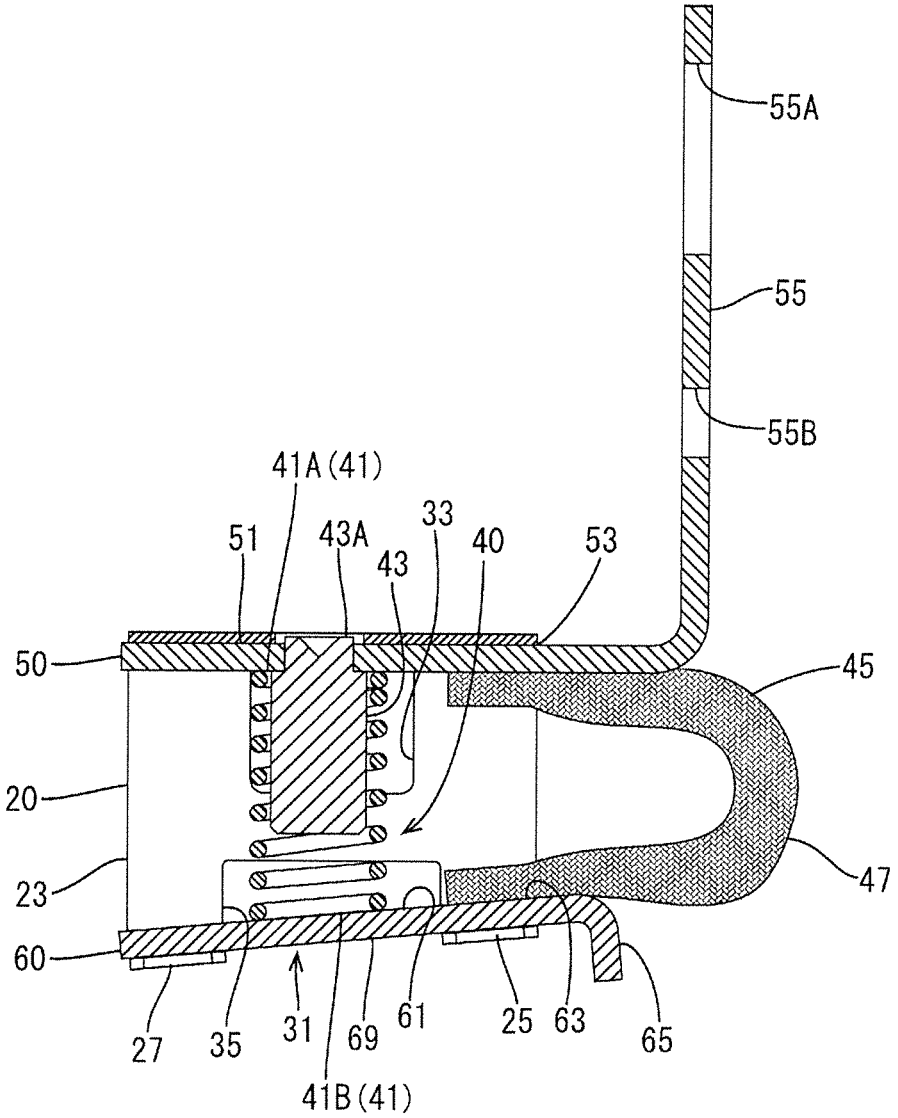
FIG. 5 is a section along V-V in FIG. 3.

As shown in FIG. 4, the supports 25, 27 are composed of left and right rear supports 25 disposed on a rear end of the electrical contact member 60 and left and right front supports 27 disposed on a front end of the electrical contact member 60. As shown in FIG. 5, an interval between the rear supports 25 and the ceiling wall 21 is smaller than that between the front supports 27 and the ceiling wall 21. Further, inner surfaces of the rear supports 25 and those of the front supports 27 are coplanar. That is, the inner surfaces of the rear supports 25 and those of the front supports 27 are arranged to form an inclined surface non-perpendicular to the center axis L of the coil spring 40.

As shown in FIGS. 1 and 5, the coil spring 40 is formed by winding a wire material made of metal, such as SUS, into a coil. The coil spring 40 is formed by, after the wire material is wound substantially one turn such that an annular winding end part 41 on one end draws a circle perpendicular to the center axis L, spirally winding the wire material and winding the wire material substantially one turn such that an annular winding end part 41 on the other end draws a circle perpendicular to the center axis L. A length of the coil spring 40 is equal over the entire circumference about the center axis L in a natural state.

The coil spring 40 is sandwiched in a compressed state by the intermediate terminal 50 and the electrical contact 60. Thus, the winding end part 41A on the upper end is in contact with the intermediate terminal 50 and the winding end part 41B on the lower end is in contact with the electrical contact 60. Thus, the coil spring 40 biases both the intermediate terminal 50 and the electrical contact 60, the intermediate terminal 50 is pressed against the inner surface of the ceiling wall 21 and the electrical contact 60 is pressed against the supports 25, 27 of the case 20.

Note that a holding shaft 43 is inserted into the coil spring 40, as shown in FIGS. 1 and 5. This holding shaft 43 is made of metal, such as brass, and is fixed to the intermediate terminal 50 by caulking or the like.

Further, the lower end of the holding shaft 43 is located above the upper end positions of the second openings 35. Specifically, the lower end of the holding shaft 43 is disposed at a lowermost position within a range where the lower end of the holding shaft 43 and the electrical contact 60 do not interfere when the electrical contact 60 is lifted up by the mating terminal 90, thereby suppressing inclination of the coil spring 40 due to a vertical force.

As shown in FIGS. 1 and 5, the intermediate terminal 50 is formed by press-working a metal plate material, such as copper alloy, and is sandwiched between the ceiling wall 21 and the coil spring 40. The intermediate terminal 50 includes a first spring receiving portion 51 for supporting the upper end of the coil spring 40, a first braided wire connecting portion 53 disposed behind the first spring receiving portion 51 and a device-side connecting portion 55 (example of a "terminal portion") rising up while being perpendicular to the first spring receiving portion 51 and the first braided wire connecting portion 53. The device-side connecting portion 55 is provided with a bolt hole 55A and a locking hole 55B.

A fixing hole 51A penetrates through the first spring receiving portion 51. The intermediate terminal 50 and the holding shaft 43 are fixed by inserting an upper end part 43A of the holding shaft 43 into the fixing hole 51A and caulking the upper end part 43A. This caulked part of the holding shaft 43 is accommodated in the escaping hole 37 of the case 20. Further, two first bulges 57 are provided on both side edges of the first spring receiving portion 51 and are disposed in the first openings 33. Dimensions of the first bulges 57 in the front-rear direction are substantially equal to or slightly smaller than those of the first openings 33 in the front-rear direction. Thus, movements of the intermediate terminal 50 in the front-rear direction are suppressed by the contact of the first bulges 57 with front and rear opening edges of the first openings 33. On the other hand, the first openings 33 are open down from the ceiling wall 21 and allow the intermediate terminal 50 to move downward.

As shown in FIGS. 1 and 5, the electrical contact 60 is formed by press-working a metal plate material, such as copper alloy, and is sandwiched in an inclined state non-perpendicular to the center axis L of the coil spring 40 between the inner surfaces of the supports 25, 27 and the coil spring 40. Further, a plate thickness of the electrical contact 60 is set by a capacitance required for the terminal fitting 10, and the electrical contact 60 has such plate thickness and hardness to regard the electrical contact 60 as a rigid body in comparison to the coil spring 40.

The electrical contact 60 includes a second spring receiving portion 61 for receiving the winding end part 41B on the lower end of the coil spring 40, a second braided wire connecting portion 63 supported by the rear supports 25 of the case 20 and a bent piece 65 bent down while being perpendicular to the second spring receiving portion 61 and the second braided wire connecting portion 63. The second braided wire connecting portion 63 is at a position facing the first braided wire connecting portion 53. Further, although the electrical contact 60 is accommodated mostly inside the case 20, the bent piece 65 and second bulges 67 to be described later are disposed outside the case 20.

The second spring receiving portion 61 is located between the rear supports 25 and the front supports 27 and a lower surface side thereof is exposed to the outside of the case 20 through the opening 31 of the case 20. The lower surface side of this second spring receiving portion 61 serves as a contact portion 69 with the mating terminal 90. Further, the two second bulges 67 are provided on both side edges of the second spring receiving portion 61 and are disposed in the second openings 35. Dimensions of the second bulges 67 in the front-rear direction are substantially equal to or slightly smaller than those of the upper end edges of the second openings 35 in the front-rear direction. Thus, movements of the intermediate terminal 50 in the front-rear direction are suppressed by the contact of the second bulges 67 with front and rear opening edges of the second openings 35. On the other hand, the second openings 35 communicate with the opening 31 and are open upward. Thus, the second openings 35 allow an upward movement of the electrical contact 60.

The braided wire 45 is produced by braiding metal strands made of copper or the like having conductivity. As shown in FIG. 5, both end parts of the braided wire 45 are connected to the first braided wire connecting portion 53 of the intermediate terminal 50 and the second braided wire connecting portion 63 of the electrical contact 60 by resistance welding. An intermediate part 47 of the braided wire 45 is disposed outside the case 20 and has a substantially U shape with an extra length. When the intermediate terminal 50 and the electrical contact 60 relatively move, the intermediate part 47 resiliently deforms. Thus, the braided wire 45 does not impede movements when the intermediate terminal 50 and the electrical contact member 60 relatively move.

Figure 6:
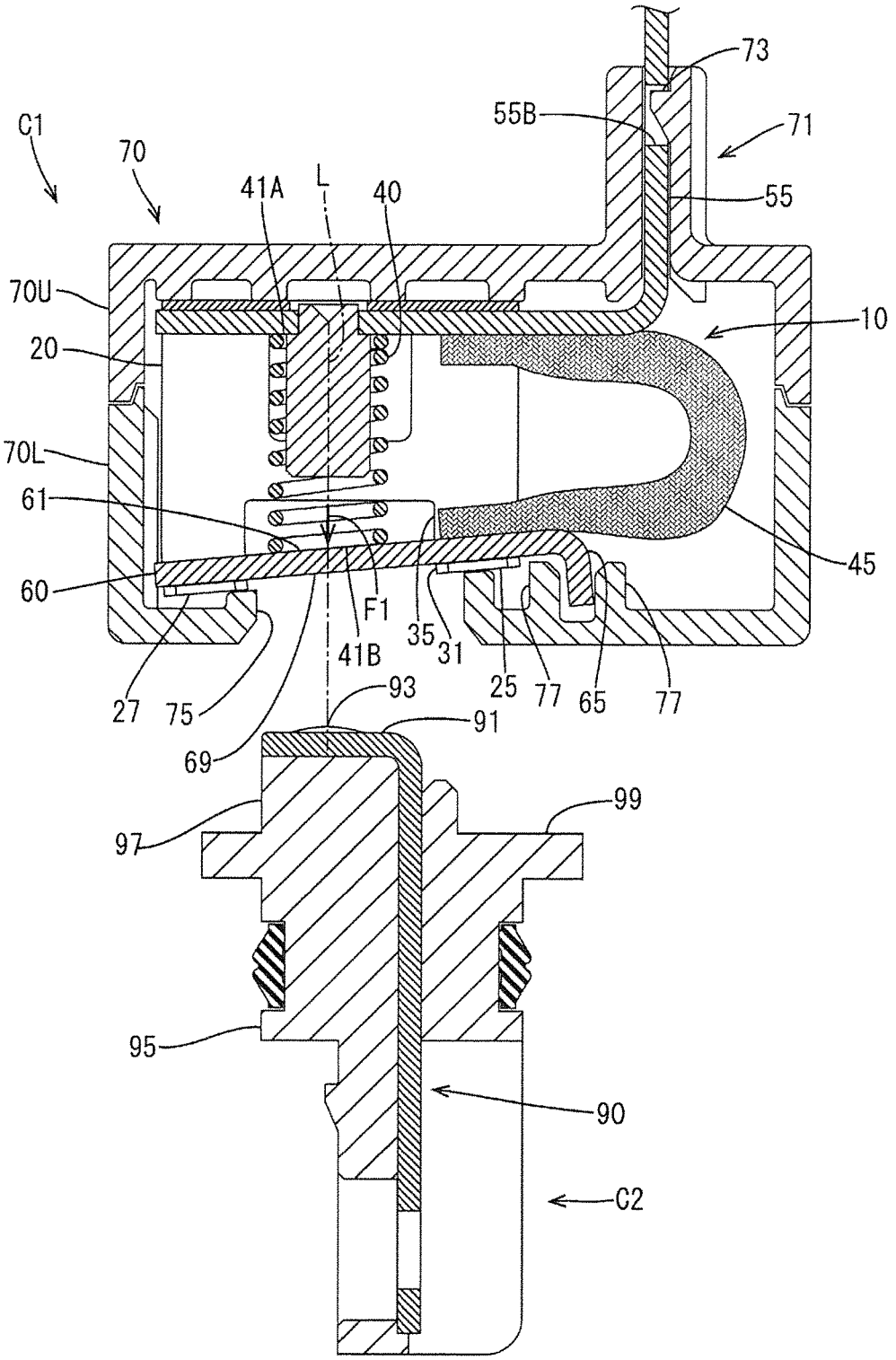
FIG. 6 is a section showing a state before a connector and a mating connector are connected.

As shown in FIG. 6, the terminal fitting 10 of this embodiment is accommodated inside a connector housing 70. The connector housing 70 is configured by combining an upper divided body 70U and a lower divided body 70L made of synthetic resin and vertically divided. A connector C1 is constituted by the terminal fitting 10 and the connector housing 70.

The upper divided body 70U of the connector housing 70 is provided with a lead-out portion 71 for leading the device-side connecting portion 55 out to the outside of the connector housing 70. A locking lance 73 is provided inside the lead-out portion 71. This locking lance 73 is fit into the locking hole 55B of the device-side connecting portion 55 to be locked, thereby preventing the intermediate terminal 50 from falling into the inside of the connector housing 70.

The lower divided body 70L of the connector housing 70 is provided with a housing opening 75 for allowing the entrance of the mating terminal 90. The housing opening 75 is provided substantially at the same position as the opening 31 of the terminal fitting 10, enables the electrical contact member 60 to be exposed to a lower side and enables the entrance of a fitting 97 to be described later.

Further, the lower divided body 70L of the connector housing 70 is provided with two movement restricting portions 77. The movement restricting portions 77 are provided behind the housing opening 75 and project up from the lower surface of the connector housing 70 while being separated by a predetermined interval in the front-rear direction. The bent piece 65 of the electrical contact 60 is accommodated between the two movement restricting portions 77. The interval between the movement restricting portions 77 is larger than a plate thickness of the bent piece 65 and is of such a size as not to impede the rotation of the bent piece 65 according to a rotating operation of the electrical contact member 60. Further, the movement restricting portions 77 are at the same height with each other and are higher than a lower end position of the bent piece 65 when the electrical contact 60 is located at an uppermost position (position where the second bulges 67 are in contact with the upper end edges of the second openings 35). In this way, movements of the terminal fitting 10 in the front-rear direction in the connector housing 70 are restricted.

A mating connector C2 to be connected to the connector C1 includes the mating terminal 90 and a mating housing 95 made of synthetic resin. As shown in FIG. 6, the mating terminal 90 is made of conductive metal and is formed into a substantially L shape by bending a vertical plate forward at a substantially right angle. One end of the mating terminal 90 facing the electrical contact 60 serves as the mating contact 91. The upper surface of the mating contact 91 is struck from below to form a spherical portion 93. A center position (highest point) of the spherical portion 93 is disposed on an extension of the center axis L of the coil spring 40.

Further, the mating terminal 90 is held in the mating housing 95 by insert molding. The mating contact 91 is held by the fitting 97. The fitting 97 is inserted into the housing opening 75 to connect the connector C1 and the mating connector C2. A flange 99 projects out at a lower end of the fitting 97. The insertion of the mating terminal 90 (mating contact 91) beyond a specified position is suppressed by the contact of the flange 99 with the lower surface of the connector housing 70.

The terminal fitting 10 and the connector C1 of this embodiment are configured as described above. Next, functions thereof are described.

In a state before the connector C1 and the mating connector C2 are connected, the electrical contact 60 is received by the case 20 (both supports 25, 27) while being pressed toward the opening 31 of the case 20, as shown in FIG. 6. At this time, the electrical contact 60 is held in an inclined state non-perpendicular to an action axis of a biasing force F1 (center axis L of the coil spring 40).

Further, in a state before connection, the bent piece 65 of the electrical contact 60 is accommodated between the movement restricting portions 77 of the connector housing 70 to restrict movements thereof in the front-rear direction. On the other hand, contact of the second bulges 67 (see FIG. 1) with the front and rear hole edges of the second openings 35 restrict movements of the electrical contact member 60 in the front-rear direction in the case 20. Thus, movements of the bent piece 65 with respect to the connector housing 70 are restricted so that movements of the terminal fitting 10 in the front-rear direction in the connector 70 are restricted. Further, the intermediate terminal 50 is held by the lead-out portion 71 to restrict movements of the intermediate terminal 50 with respect to the connector housing 70, and movements of the terminal fitting 10 in the front-rear direction in the connector housing 70 are restricted.

Figure 7:
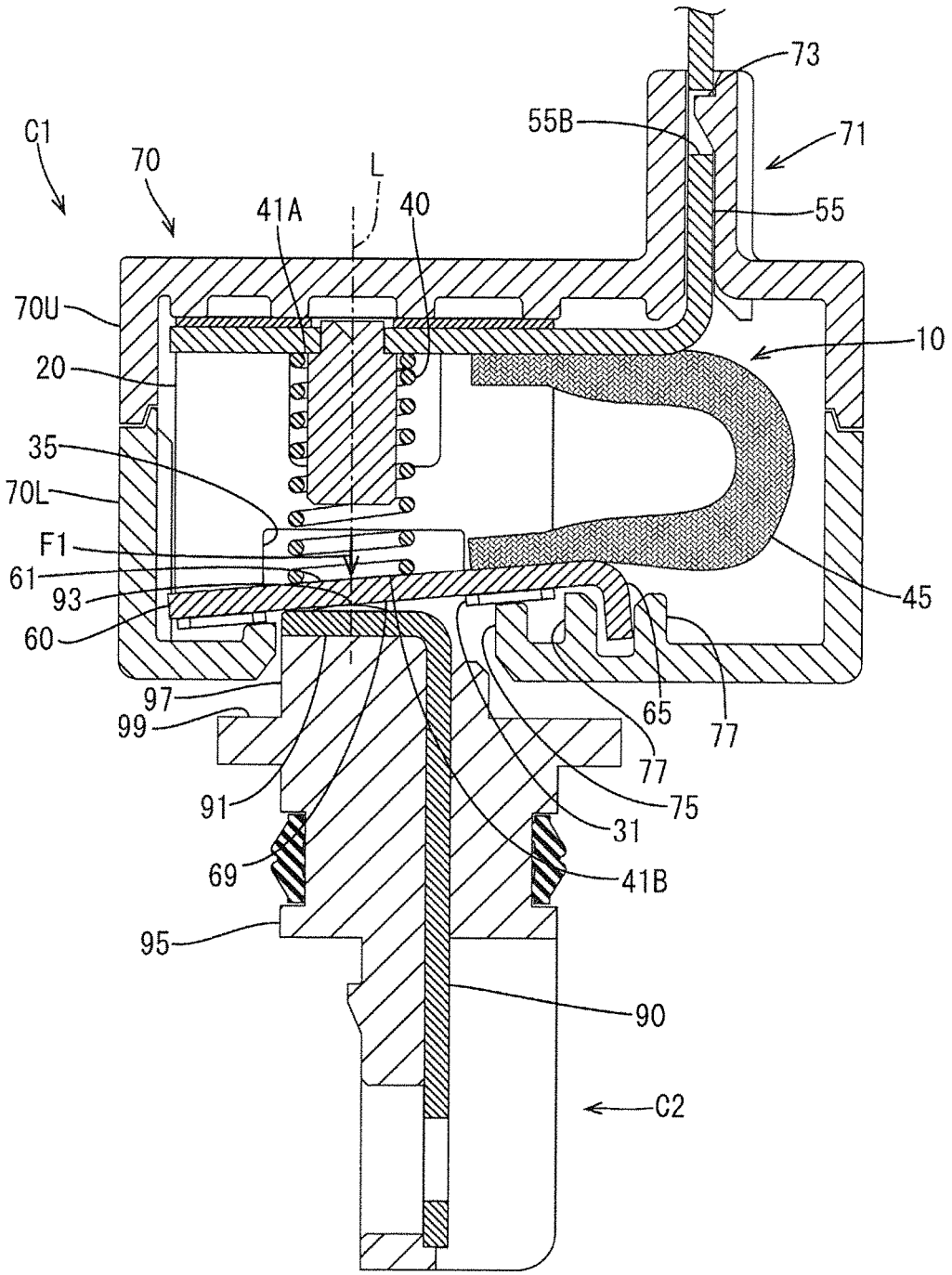
FIG. 7 is a section showing a state where a mating contact is butted against an electrical contact member from the state of FIG. 6.
Figure 8:
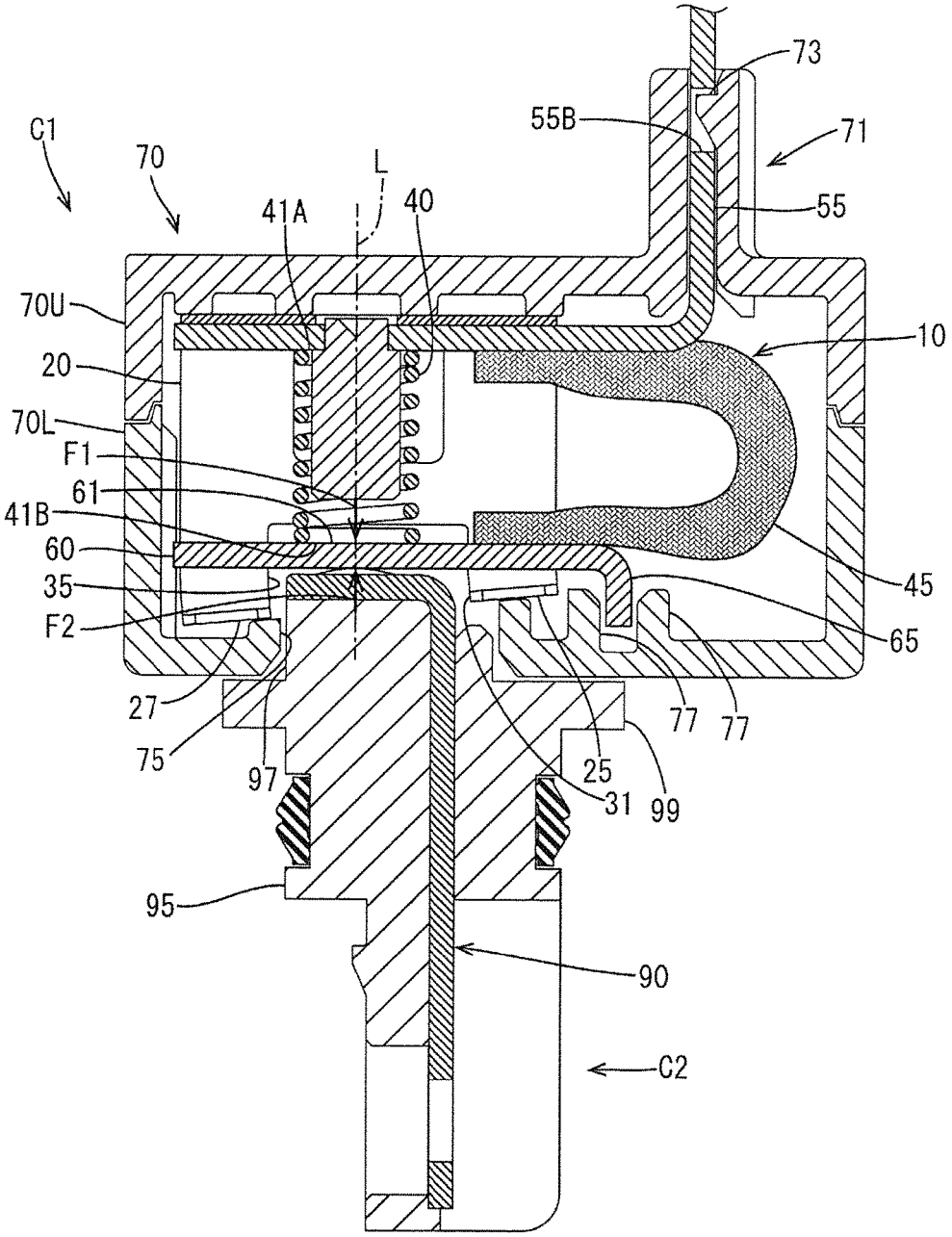
FIG. 8 is a section showing a state where the connector and the mating connector are completely connected from the state of FIG. 7.

When the connector C1 and the mating connector C2 are brought closer, the mating contact 91 of the mating terminal 90 is inserted through the housing opening 75 of the connector housing 70 and the opening 31 of the case 20, as shown in FIG. 7. At this time, the spherical portion 93 of the mating contact 91 moves along the center axis L of the coil spring 40. In this way, the mating contact 91 butts against the contact portion 69 of the electrical contact 60. When the connector C1 and the mating connector C2 are brought even closer, the connector C1 and the mating connector C2 are connected completely, as shown in FIG. 8. By pressing the electrical contact 60 toward the mating contact 91 by the coil spring 40 in this way, the electrical contact 60 and the mating contact 91 are connected electrically.

Figure 9:
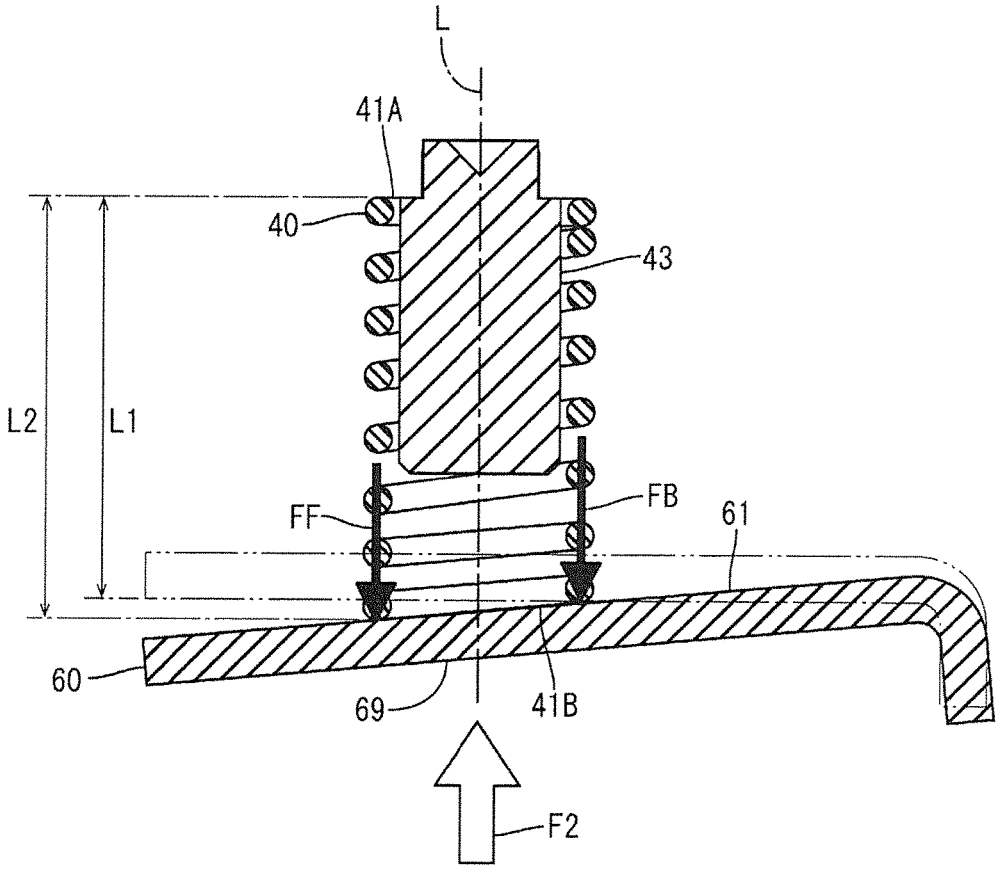
FIG. 9 is a schematic view showing a situation of forces applied to the electrical contact.

Subsequently, the rotating operation of the electrical contact 60 is described using FIGS. 6 to 9. In an initial state before the connector C1 and the mating connector C2 are connected, the electrical contact member 60 is held in the inclined state non-perpendicular to the center axis L of the coil spring 40, as shown in FIG. 6. In this state, as shown in FIG. 9, a vertical dimension L1 of the coil spring 40 on one side and a vertical dimension L2 thereof on the other side are different, i.e. L2>L1. That is, the length L1 on the rear side is shorter than the length L2 on the front side across the center axis L of the coil spring 40.

As just described, the length of the coil spring 40 differs on the front side and the rear side across the center axis L. Thus, a biasing force (spring force) caused by the compression of the coil spring 40 generates a spring force FB on the one side (spring force behind the contact axis L) and a spring force FA on the other side (spring force before the center axis L) having different magnitudes. The magnitudes of the respective forces are in a relationship of FF<FB. Note that if the spring forces of the coil spring 40 within an area of the winding end part 41B are combined, a biasing force F1 of the entire coil spring 40 is obtained. An action axis of the biasing force F1 is disposed on the center axis L of the coil spring 40. In this state, the electrical contact member 60 is held with the biasing force F1 of the coil spring 40 and supporting forces by both supports 25, 27 of the case 20 balanced.

When a pressing force F2 from the mating contact 91 is applied to the electrical contact 60, as shown in FIGS. 8 and 9, the electrical contact 60 is separated from the supports 25, 27 of the case 20. In this state, the electrical contact 60 rotates to be perpendicular to the center axis L of the coil spring 40, shown by a chain double-dashed line of FIG. 9, so that the spring forces FF and FB become an equal spring force of the coil spring 40 within the area of the winding end part 41B (magnitudes of the forces become FF=FB).

Note that, during the rotating operation of the electrical contact member 60, an action axis of the mating contact 91 is disposed within areas of the electrical contact 60 and annular winding end part 41B. The mating contact 91 presses the area of the coil spring 40 inside the winding end part 41B so that the electrical contact 60 can be supported by the mating contact 91 as a supporting point at the time of the rotating operation. Further, since the winding end part 41B of the coil spring 40 and the mating contact 91 are proximate, a position of the electrical contact 60 where a force is applied also is proximate. Thus, a rotation moment applied to the electrical contact 60 does not become excessive and the force applied to rotate the electrical contact 60 is small and stabilized.

After the rotation of the electrical contact 60, the electrical contact 60 is horizontal and the action axis of the biasing force F1 on the electrical contact 60 from the entire coil spring 40 and the action axis of the pressing force F2 from the mating contact 91 are matched and stabilized. In this way, the electrical contact 60 is sandwiched in the horizontal state (state perpendicular to the center axis L of the coil spring 40) by the biasing force F1 of the entire coil spring 40 and the pressing force F2 of the mating contact 91.

Figure 10:
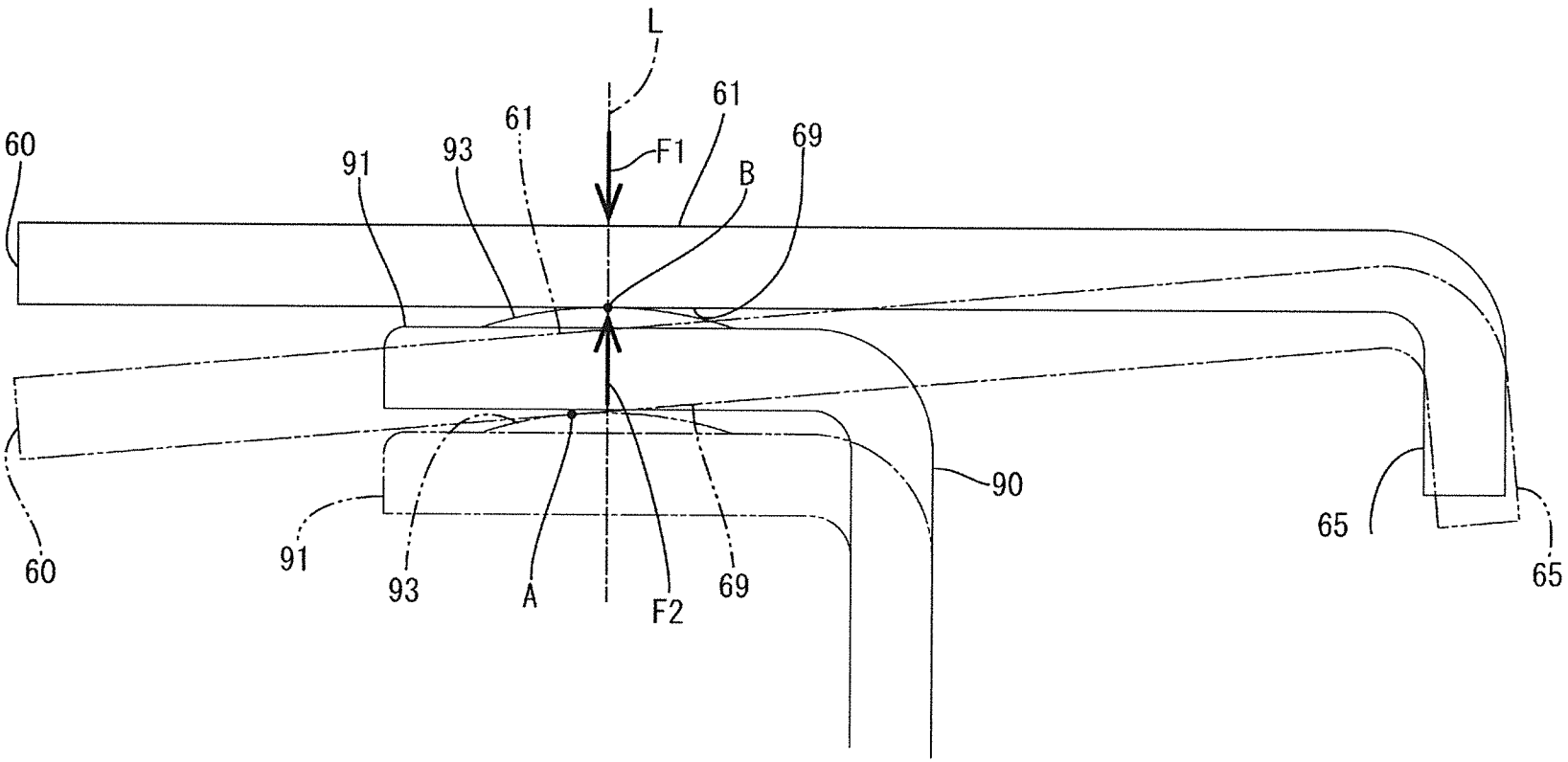
FIG. 10 is a schematic view showing a sliding situation of the electrical contact and the mating contact.

As just described, when the electrical contact 60 rotates to change an angle of inclination from an initial posture, the electrical contact 60 slides on the mating contact 91. This sliding movement is described using FIG. 10. With the mating contact 91 butted against the electrical contact 60, the mating contact 91 and the contact 69 of the electrical contact 60 are in point contact at a point A, as shown by a chain double-dashed line of FIG. 10. In this state, the pressing force F2 from the mating contact 91 is hardly applied to the electrical contact 60. Thus, as shown in FIGS. 7 and 10, the electrical contact 60 is supported in the inclined state non-perpendicular to the center axis L of the coil spring 40 (action axis of the biasing force F1 of the coil spring 40) by both supports 25, 27. More specifically, a front side (side opposite to the bent piece 65) of the electrical contact 60 is closer to the mating contact 91 than a rear end side.

The electrical contact 60 is supported in the inclined state with the front end thereof lowered as just described. Thus, the contact 69 and the mating contact 91 come into point contact at the point A located before a center position (point on the center axis L) of the spherical portion 93 of the mating contact 91 when the mating contact 91 butts against the electrical contact 60. The contact position (point A) is deviated forward from the action axes (center axis L) of the biasing force F1 and the pressing force F2, and the spring forces FF, FB in the coil spring 40 are not equal. Therefore, a rotational force acts on the electrical contact 60, and the electrical contact 60 tries to rotate about a contact point with the mating contact 91 while being held in contact with the mating contact 91. Thus, as the mating contact 91 is inserted into the case 20, the electrical contact 60 rotates while being moved up (inwardly of the case 20) by the mating contact 91. The electrical contact 60 moves while rotating until a point B where the contact 69 and the mating contact 91 are in contact on the action axes (center axis L) of the biasing force F1 and the pressing force F2.

That is, while the electrical contact 60 and the mating contact 91 move from a first butting state (state of FIG. 7) to a connected state (state of FIG. 8), the electrical contact 60 retreats from the initial position while rotating to change an angle of inclination. At this time, as shown in FIG. 9, the electrical contact 60 and the mating contact 91 rub against each other to shift the contact point from the point A to the point B. Thus, even if external matter is present between the electrical contact 60 and the mating contact 91, that external matter is scraped off and removed from the contact part. When the connected state is reached, the electrical contact 60 is held perpendicular to the center axis L of the coil spring 40 and pressed against the mating contact 91 by the biasing force F1 of the coil spring 40.

Further, the bent piece 65 also rotates and moves as the electrical contact 60 rotates and moves. At this time, the bent piece 65 is accommodated between the movement restricting portions 77 to suppress movements of the electrical contact 60 in the front-rear direction during the rotating operation. Note that the movements of the electrical contact 60 in the front-rear direction also are restricted by restricting movements of the second bulges 67 in the front-rear direction by the second openings 35. Even after the connector C1 is connected to the mating connector C2 and the electrical contact member 60 is located at an upper position in the case 20, as shown in FIG. 8, a tip part of the bent piece 65 is accommodated between the movement restricting portions 77 to restrict movements of the electrical contact 60 in the front-rear direction in the connector housing 70.

As described above, the electrical contact 60 is received by the case 20 and assumes a predetermined initial posture by being pressed toward the opening 31 of the case 20 by the coil spring 40 in the case 20. If the mating contact 91 is inserted through the opening 31 of the case 20 in such a state, the mating contact 91 butts against the electrical contact 60 and the electrical contact 60 retreats to escape from the mating contact 91 while compressing the coil spring 40. At this time, the electrical contact 60 retreats from the initial position while rotating to change the angle of inclination, and shifts to be rubbed at the contact part with the mating contact 91. Thus, any external matter that is present is scraped off. As just described, since the electrical contact 60 shifts relative to the mating contact 91 even if the electrical contact 60 itself is not resiliently deformed, the plate thickness of the electrical contact member 60 can be increased according to a current value.

Further, the action axis of the biasing force F1 of the coil spring 40 is disposed on the same straight line (center axis L) as the action axis of the pressing force F2 of the mating contact 91, and the electrical contact 60 is held in the inclined state non-perpendicular to the action axis of the coil spring 40 in the case 20. In this configuration, the electrical contact 60 can be rotated by a simple structure that merely holds the electrical contact 60 in the inclined state.

Further, the resilient member may be the coil spring 40, the electrical contact 60 may be held in the inclined state non-perpendicular to the center axis L of the coil spring 40 in the case 20, and the action axis of the pressing force F2 of the mating contact 91 may be disposed within the area of the annular winding end part 41B of the coil spring 40 where the coil spring 40 contacts the electrical contact 60.

In this configuration, the electrical contact 60 is held in the inclined state non-perpendicular to the center axis L of the coil spring 40. Thus, the length L1 on the rear side is shorter than the length L2 on the front side across the center axis L of the coil spring 40. Thus, the biasing force (spring force) applied to the electrical contact 60 differs on the rear side) and the front side across the center axis L of the coil spring 40. If the electrical contact 60 retreats by being pressed by the mating contact 91 in this state, the mating contact 91 acts as a support and the electrical contact 60 rotates about the mating contact 91 to be perpendicular to the center axis L of the coil spring 40 to change the inclined state so that the spring forces within the areas of the winding end part 41B at both sides of the center axis L of the coil spring 40 become equal since the action axis of the pressing force F2 of the mating contact 91 is disposed within the area of the winding end part 41B on the other end of the coil spring 40. As a result, the electrical contact 60 and the mating contact 91 shift at the contact part thereof, thereby removing any external matter.

The intermediate terminal 50 located at a position to sandwich the coil spring 40 between the intermediate terminal 50 and the electrical contact 60 and including the device-side connecting portion 55 for connection to outside (device) is accommodated in the case 20, and the intermediate terminal 50 is connected to the electrical contact 60 by the flexible braided wire 45. In this configuration, connection to outside is made by the intermediate terminal 50. Thus, the rotating operation of the electrical contact 60 is not impeded by a connecting structure to outside. Further, since the electrical contact 60 is connected to the intermediate terminal 50 by the braided wire 45 and the braided wire 45 is flexible, the rotating operation of the electrical contact 60 is less likely to be impeded.

The connector C1 of this embodiment is the connector C1 including the connector housing 70 capable of accommodating the terminal fitting 10, one end of the electrical contact 60 is formed into the bent piece 65 by being bent toward the mating contact 91, and the connector housing 70 is provided with the movement restricting portions 77 for restricting movements of the bent piece 65 in a longitudinal direction of the electrical contact 60 (front-rear direction). In this configuration, movements of the electrical contact 60 in the longitudinal direction are restricted by the movement restricting portions 77 of the connector housing 70. Thus, the movements of the electrical contact 60 in the longitudinal direction during the rotating operation are restricted and the electrical contact 60 is rotated more easily.

The invention is not limited to the above described and illustrated embodiment. For example, the following modes also are included.

Although the intermediate terminal 50 is provided in the above embodiment, the intermediate terminal 50 may not be provided. In that case, the electrical contact 60 may be connected directly connected to outside by a wire or the like and an upper end of the coil spring 40 may be pressed against the inner surface of the case 20.

Although the braided wire 45 is used in the above embodiment, a coated wire may be used instead of the braided wire. Further, although the braided wire 45 is disposed outside the case 20, the braided wire 45 may be disposed in the case 20 or in the coil spring 40.

Although movements of the electrical contact 60 in the front-rear direction are restricted by the contact of the second bulges 67 with the hole edges of the second openings 35 in the above embodiment, the second bulges 67 and the second openings 35 may not be provided.

Although movements of the electrical contact 60 and the terminal fitting 10 in the front-rear direction are restricted by the bent piece 65 being accommodated between the pair of movement restricting portions 77 in the above embodiment, the bent piece 65 and the pair of movement restricting portions 77 may not be provided. Further, a single movement restricting portion may be provided on one side instead of the pair of movement restricting portions 77.

Although the electrical contact 60 is held in the inclined state in the above embodiment, the electrical contact 60 may be held perpendicular to the center axis L of the coil spring 40. In that case, the electrical contact member 60 may be rotated by a deviation of the butting position of the mating contact 91 from the center axis L of the coil spring 40 or may be rotated by making forces of a plurality of resilient members unequal.

Although the coil spring 40 is used as the resilient member in the above embodiment, another resilient member such as high-strength rubber may be used. Further, the holding shaft 43 may not be disposed in the center of the coil spring 40.

LIST OF REFERENCE SIGNS

10 . . . terminal fitting
20 . . . case
25 . . . rear support
27 . . . front supporting portion
31 . . . opening
40 . . . coil spring (resilient member)
41 . . . winding end part
45 . . . braided wire
50 . . . intermediate terminal
55 . . . device-side connecting portion (terminal portion)
60 . . . electrical contact
65 . . . bent piece
69 . . . contact
70 . . . connector housing
75 . . . housing opening
77 . . . movement restricting portion
90 . . . mating terminal
91 . . . mating contact
93 . . . spherical portion
L . . . center axis
C1 . . . connector
C2 . . . mating connector

The invention claimed is:

1. A terminal fitting, comprising:

a case provided with an opening, a mating contact being inserted into the opening; and an electrical contact disposed in the case to face the opening, the electrical contact being configured to retreat while rotating to compress a resilient member by being biased toward the opening and pressed against the mating contact by the resilient member;

wherein:

the resilient member is a coil spring;

the electrical contact is held in an inclined state non-perpendicular to a center axis of the coil spring in the case; and an action axis of a pressing force of the mating contact is disposed within an area of annular winding end part of the coil spring that is in contact with the electrical contact member.

2. The terminal fitting of claim 1, wherein:

an action axis of a biasing force of the resilient member is disposed on the same straight line as the action axis of the pressing force of the mating contact; and the electrical contact is held in an inclined state non-perpendicular to an action axis of the resilient member in the case.

3. The terminal fitting of claim 2, further comprising an intermediate terminal including a terminal portion for connection to outside, the intermediate terminal accommodated in the case and located to sandwich the resilient member between a terminal portion and the electrical contact, and the intermediate terminal is connected to the electrical contact by a flexible braided wire.

4. A connector, comprising a connector housing capable of accommodating the terminal fitting of claim 1, wherein:

one end of the electrical contact is formed into a bent piece bent toward the mating contact; and the connector housing is provided with a movement restricting portion for restricting a movement of the bent piece in a longitudinal direction of the electrical contact.

5. The terminal fitting of claim 1, further comprising an intermediate terminal including a terminal portion for connection to outside, the intermediate terminal accommodated in the case and located to sandwich the resilient member between a terminal portion and the electrical contact, and the intermediate terminal is connected to the electrical contact by a flexible braided wire.

* * * * *